United States Patent [19]

Chikada et al.

[11] Patent Number: 4,623,304

[45] Date of Patent: Nov. 18, 1986

[54] HERMETICALLY SEALED ROTARY COMPRESSOR

[75] Inventors: Ichizo Chikada, Ota; Isamu Shoji, Ashikaga; Hideyasu Sakaniwa, Honjo, all of Japan

[73] Assignees: Sanyo Electric Co., Ltd., Osaka; Tokyo Sanyo Electric Co., Ltd., Gunma, both of Japan

[21] Appl. No.: 447,646

[22] Filed: Dec. 7, 1982

[30] Foreign Application Priority Data

Dec. 8, 1981 [JP] Japan ..... 56-197971
Mar. 2, 1982 [JP] Japan ..... 57-33677

[51] Int. Cl.[4] ..... F04B 21/00; F04B 35/04

[52] U.S. Cl. ..... 417/312; 417/410; 417/902

[58] Field of Search ..... 417/410, 312, 366, 902, 417/422; 62/508

[56] References Cited

U.S. PATENT DOCUMENTS

| | | | |
|---|---|---|---|
| 2,137,962 | 11/1938 | Weiher | 417/902 |
| 2,200,222 | 5/1940 | Tarleton | 417/312 |
| 2,612,311 | 9/1952 | Warrick et al. | 417/410 |
| 3,003,684 | 10/1961 | Tarleton | 417/902 |
| 3,015,222 | 1/1962 | Wellborn et al. | 417/902 |
| 3,016,183 | 1/1962 | Murphy et al. | 417/902 |
| 3,423,013 | 1/1969 | Rinehart | 417/410 |
| 3,532,448 | 10/1970 | Rinehart | 417/410 |
| 3,790,311 | 2/1974 | Butts et al. | 417/410 |
| 3,850,551 | 11/1974 | Gamacha et al. | 417/410 |

FOREIGN PATENT DOCUMENTS

| | | | |
|---|---|---|---|
| 57-86592 | 5/1982 | Japan | 417/902 |

*Primary Examiner*—Cornelius J. Husar
*Assistant Examiner*—Peter M. Cuomo
*Attorney, Agent, or Firm*—Stiefel, Gross, Kurland & Pavane

[57] ABSTRACT

A hermetically sealed rotary compressor is disclosed which comprises a vertically disposed hermetically sealed cylindrical casing, an electric motor force fitted in the casing in coaxial relation therewith, a rotary refrigerant compressing device driven by the motor, the compressing device having a cylinder block having a side wall provided with a concavity, said casing having a side wall to which a terminal for feeding electrical power to the motor is attached, and a space formed with the concavity of the cylinder block, the space being adapted to receive electrical equipments to be connected with the terminal, the cylinder block being force fitted and secured in the casing such that the side surface of the block is brought into contact with the internal wall of the casing except for the concavity. The overall height of the compressor is lowered and noise produced by the compressor is reduced.

8 Claims, 6 Drawing Figures

HERMETICALLY SEALED ROTARY COMPRESSOR

BACKGROUND OF THE INVENTION

The present invention relates to an improved hermetically sealed rotary compressor.

Generally, rotary compressors produce less vibration and have a crank of shorter eccentricity as compared with reciprocating compressors, and therefore they are well suited to small-sized, hermetically sealed compressors. However, conventional hermetically sealed rotary compressors have had a cylinder block which is cut out considerably except for legs pressed into the internal wall of the sealed casing in order to curtail expenditure for raw material. Accordingly, the cutout has lowered the rigidity of most of the hermetically sealed casings, that is, except for the portion in which the cylinder block is force fitted, and has made noise louder. Thus, no sufficient countermeasures have been taken against noise (see U.S. Pat. No. 3,743,454).

Meanwhile, prior art hermetically sealed rotary compressors have been successfully miniaturized to some extent. Nevertheless, compressors of this kind have large overall heights, because such a compressor consists essentially of a vertically disposed hermetially sealed cylindrical casing cylinder, an electric motor force fitted in the casing in coaxial relation therewith and a rotary refrigerant compressing device disposed below the motor (see the above-cited U.S. Pat. No. 3,743,454). Consequently, air conditioners, freezers, refrigerators and so forth into which such a compressor is incorporated are difficult to manufacture compactly.

Accordingly, it is a principal object of the present invention to privide a small-size, low-noise compressor which has a lowered overall height yet has a capability comparable with those of conventional machines.

SUMMARY OF THE INVENTION

In accordance with the present invention, a hermetically sealed rotary compressor is provided which comprises a vertically disposed hermetically sealed cylindrical casing, an electric motor force fitted in the casing in coaxial relation therewith, a rotary refrigerant compressing device driven by the motor, said compressing device having a cylinder block having a side wall provided with a concavity, the top and bottom surfaces of the cylinder being provided with top and bottom end plates respectively, said casing having a side wall to which a terminal for feeding electrical power to the motor is attached, and a space formed with said concavity of the cylinder block and the internal surface of the casing, the space being adapted to receive electrical equipments to be connected with said terminal, said cylinder block being force fitted and secured in the casing such that the side surface of the block is brought into contact with the internal wall of the casing except for said concavity.

In one feature of the present invention, the said wall of the cylinder block of a refrigerant compressing device is provided with a concavity for receiving electrical equipments connected with a feeder terminal.

In another feature of the invention, the aforementioned cylinder block is formed into substantially circular shape in plan, and is force fitted and secured in a hermetically sealed casing such that the block is brought into contact with the full internal surface except for the concavity, whereby the overall height of the compressor can be lowered and, at the same time, noise can be reduced.

DESCRIPTION OF THE PREFERRED EMBODIMENTS

Figure 1:
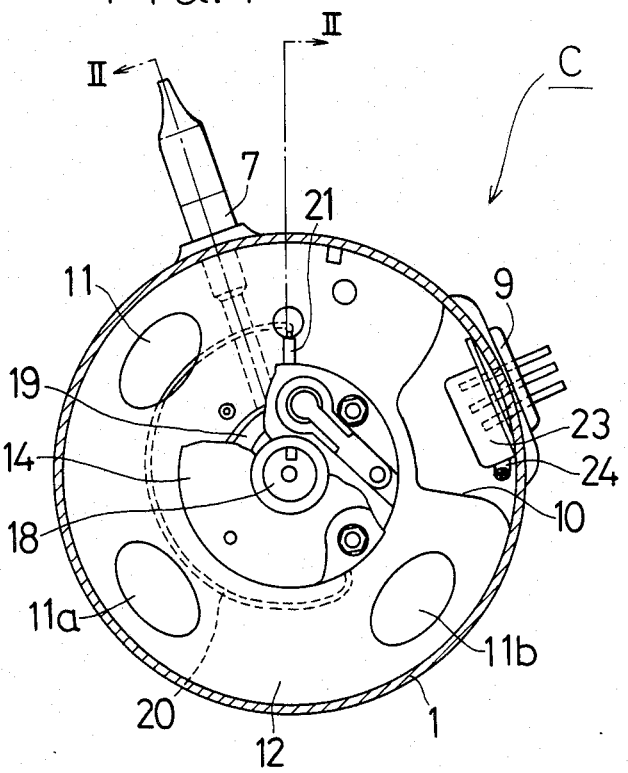
FIG. 1 is a plan view of one embodiment of hermetically sealed rotary compressor according to the present invention.
Figure 2:
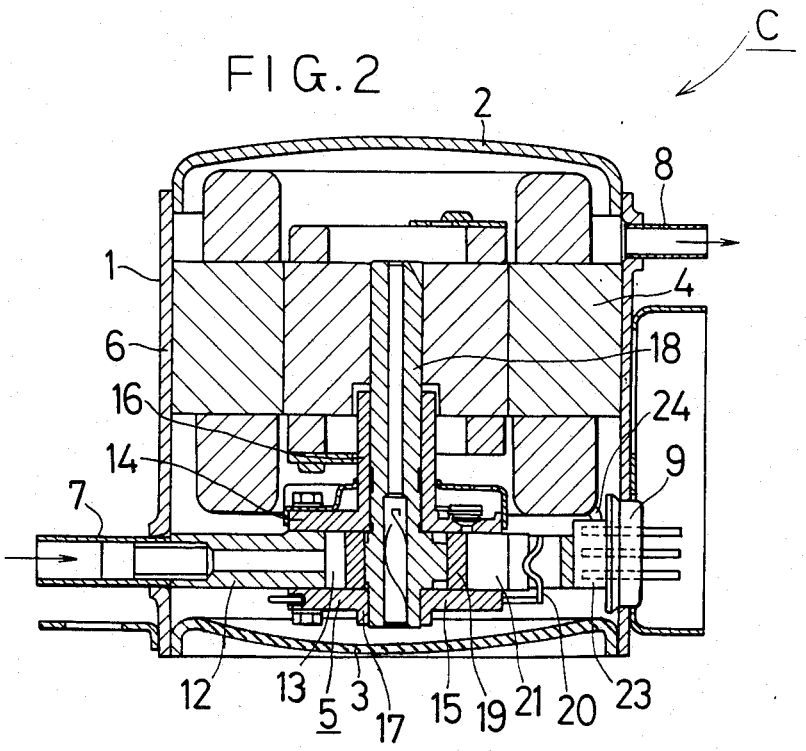
FIG. 2 is a longitudinal cross section taken along line II—II of FIG. 1.

The preferred embodiments of the present invention are hereinafter described with reference to accompanying drawings. Referring first to FIGS. 1 and 2, there is shown a hermetically sealed rotary compressor C which includes a hermetically sealed cylindrical casing 1 having a top wall 2 and a bottom wall 3 in its upper and lower portions, respectively. An electric motor 4 and a refrigerant compressing device 5 are force fitted in the casing 1 so that their axes are parallel to the center axis of the casing. Securely fixed to the side wall 6 of the casing are a refrigerant suction pipe 7, a discharge pipe 8 and a terminal 9 for feeding electrical power to the motor 4. The compressing device 5 is formed into a substantially circular shape in plan, and it consists of a cylinder block 12 having a cylinder 13, top and bottom end plates 14 and 15, respectively, mounted on the end surfaces of the cylinder 13, a roller 19, and a vane 21. The cylinder block 12 is provided with an relief concavity 10 in position for receiving electrical equipments, that is, a lead wire 24 and a connector 23. The block 12 is further provided with elliptic through-holes 11, **11*a* and 11*b* perforated vertically in position, the longitudinal axes of the ellipses lying in the circumferential direction of the casing. A drive shaft 18 is rotatably supported by bearings 16 and 17 and transmits a rotating force from the motor 4 to the roller 19 to rotate it within the cylinder 13. The vane 21 is urged into abutting engagement with the periphery of the roller 19 by a spring 20 to partition the inside of the cylinder 13** into two chambers, one for suction and the other for discharge.

In the hermetically sealed rotary compressor C thus constructed, the cylinder block 12 of the refrigerant compressing device 5 is formed into a substantially circular shape in plan and is provided with the holes 11, **11*a* and 11*b* in position and, accordingly, it can be force fitted in the sealed casing 1 so that it may be brought into contact with the substantially all internal surface of the side wall 6. As a result, the wall portion of the casing 1 acting as resonator is decreased and noise produced from the compressor is substantially reduced without the especial necessity of material for increasing the rigidity of the cylinder block 12 or the casing 1. Further, the holes in the block accelerate return of oil and improve heat dissipation. Furthermore, the terminal 9 for feeding electrical power to the motor mounted on the side wall 6 of the casing 1 and the associated electrical equipments are reasonably disposed by making use of the space surrounded by the motor 4, the relief concavity 10 for the cylinder block 12 and the bottom wall 3 of the casing 1**. Thus, the height of the compressor can be lowered, whereby contributing to miniaturization of the compressor.

As described above, the compressor C has the sealed casing, which is increased in rigidity and reduces noise produced from the compressor substantially. Further, the reasonable arrangement of the feeding terminal lowers the overall height of the compressor, whereby the compressor can be compactly manufactured with its capacity undiminished.

Figure 3:
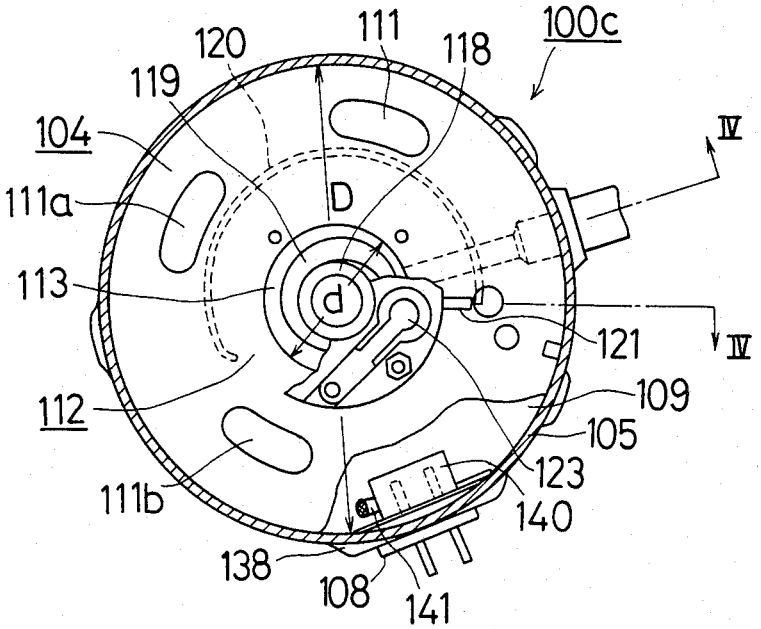
FIG. 3 is a transverse cross section of another embodiment of hermetically sealed rotary compressor according to the invention.
Figure 4:
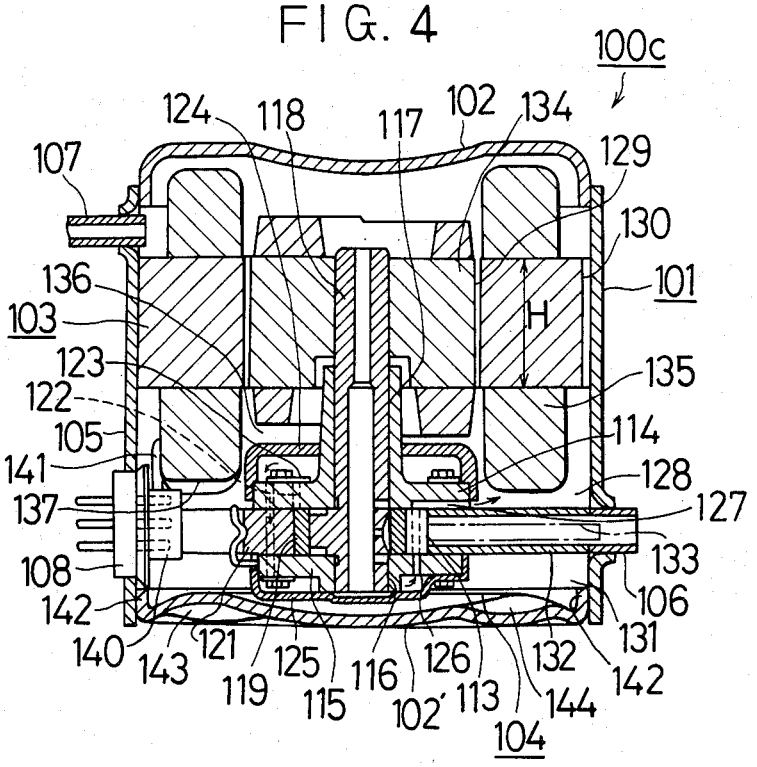
FIG. 4 is a longitudinal cross section taken along line IV—IV of FIG. 3.
Figure 5:
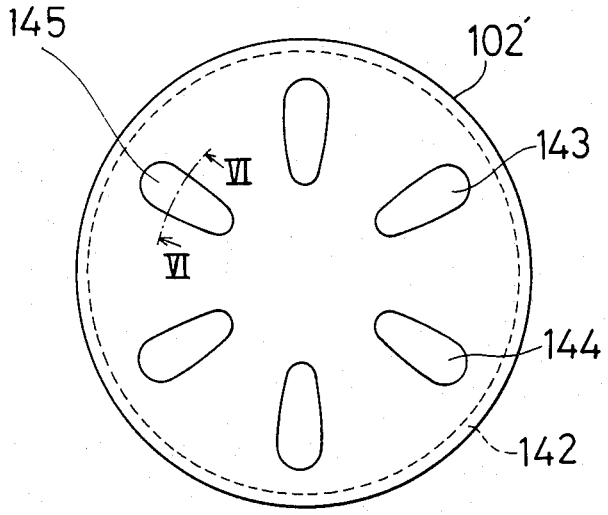
FIG. 5 is a bottom view of the bottom wall of FIG. 4.
Figure 6:
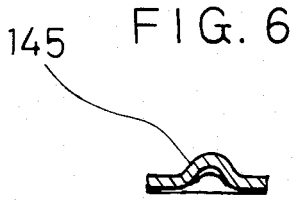
FIG. 6 is a cross section taken on line VI—VI of FIG. 5.

FIGS. 3 and 4, show an another example of hermetically sealed rotary compressor according to the present invention. In particular, a compressor 100C includes a cylindrical, hermetically sealed casing 101 having a cylindrical side wall 105, a top wall 102 closing the upper opening of the side wall and a bottom wall 102' closing the lower opening of the side wall. An electric motor 103 and a refrigerant compressing device 104 are force fitted or shrink fitted in the casing 101 such that their axes are parallel to the center axis of the casing. A refrigerant suction pipe 106, a discharge pipe 107 and a terminal for feeding electrical power to the motor 103 are force fitted to the side wall 105. The compressing device 104 consists of a cylinder block 112 having a cylinder 113, top and bottom end plates 114 and 115, respectively, mounted on the cylinder portion, a roller 119, and a vane 121. The cylinder block 112 is provided with a relief concavity 109 for relieving or receiving electrical equipment. The block 112 is further provided with flattened circular throughholes 111, **111*a* and 111*b* extending vertically, the longitudinal axes of the elliptic circles being arranged along the circumference of the casing. A drive shaft 118 is rotatably supported by bearings 116 and 117 on the respective end plates 114 and 115 and transmits a rotating force from the motor 103 to the roller 119 to rotate it within the cylinder 113. The vane 121 is pressed by the spring and maintained in continuous sealing engagement with the periphery of the roller 119 by a spring 120 to partition the inside of the cylinder 113 into two chambers, one for suction and the other for discharge. The bottom wall 102' has reinforcing ribs 143, 144 and 145 radiating from the center and also has upwardly bending portions 142 to weld C the bottom wall 102' to the inner surface of the side wall 105**.

The manner in which gaseous refrigerant flows is now described. Gaseous refrigerant which is sucked in the cylinder 113 through the suction pipe 106 is pressurized with rotation of the roller 119, and then it is discharged to a discharge muffler 124 through a discharge port 122 and a discharge valve 123, that are provided in the end plate 114. Thereafter, it passes through holes extending through the end plate 114, cylinder block 112 and end plate 115 and then it is directed to an auxiliary discharge muffler 125 mounted on the end plate 115 for muffling purposes. The refrigerant then passes through a through-hole 126 and a passage 127, which is defined between the end plate 114 and the block 112, and is discharged into a space 128 within the sealed casing.

The gaseous refrigerant which has been sucked into the cylinder and compressed by the compressing device 104 and whose pulsating noise has been attenuated by means of the discharge mufflers 124 and 125 as described hereinbefore contains still a large quantity of oil droplets. Thus, the refrigerant is moved upward through an air gap 129 in the motor and a gap 130 formed between the motor 103 and the casing 101 to separate the oil mist, which is then returned to an oil sump 131 in the casing. The refrigerant is then supplied through the discharge pipe 107 to an outside refrigerant cycle system (not shown) as pressurized gas.

In this process if a separate adiabatic pipe 133 is inserted in a passage 132 which connects the suction pipe 106 to the cylinder 113 to prevent refrigerant flowing into the cylinder 113 from overheating in the process of compressing the sucked refrigerant, then the comoress-.ion efficiency of the compressing device 104 will be improved, and the compressor will be well suited especially to low temperature refrigerant compressors, such as a refrigerator. Further, if the discharge muffler 124 is made of a cup which is fabricated by forging, and if the cup is securely fixed to the cylinder 113 with a bolt (not shown), then the compressor will produce less noise as compared with a compressor equipped with a muffler which is fabricated from a sheet metal by forming.

Since the rotary compressor 100C is provided with the discharge port 122 and discharge valve 123 for discharging the refrigerant pressurized in the cylinder 113 first toward the motor 103, as well as the discharge muffler 124 fully utilizing the space 136 which is formed by the rotor 134 and winding 135 of the motor and the cylinder block 112, it reduces noise while assisted by the noise insulating effect of the winding. Thus, the novel compressor has an advantage that is produces less noise as compared with conventional rotary compressors of this kind.

In the construction described above, if the inner diameter D of the sealed casing 101 is set greater than the three times the inner diameter d of the cylinder 113, then the laminated core height H of the motor 103 can be made smaller than the inner diameter d and the diameter of the rotor 134 can be made large, so that the necessary driving torque is obtained. Further, the space 136 is made sufficiently spacious. These lend themselves to attachment of the muffler 124 to the end plate 114, the muffler providing the necessary noise attenuating action and permitting lowering of the height of the compressor.

Furthermore, the compressor 100C makes use of the space surrounded by the assembly of the muffler 124 and motor 3, the concavity 109 in the cylinder block for relieving or receiving the electrical equipments and the top wall 102 of the sealed casing to install the terminal 108 for feeding electrical power to the motor 103. Consequently, a lowered, small-sized hermetically sealed compressor can be provided by using such electrical equipments for compressor that are commercially available without the necessity of empolying small-sized parts specially designed for the inventive compressor.

If installation of the terminal requires, the stator coil 135 of the motor may be partially provided with a relief portion 137 to assure a sufficient insulation distance between the terminal 108 and the coil 135. Also, if the portion into which the terminal 138 is installed is so shaped that clamping stress due to the cylindrical casing can be relieved, then application of excessive stress to the cylinder 113 after the force fitting of the cylinder block 112 and distortion of the shape of the cylinder 113 are prevented. As a result, it is possible to fabricate the cylinder block from gray cast iron by forging, for example.

Thus, the hermetically sealed rotary compressor 100C can lower its height by the rational arrangement of the discharge muffler of the compressing device, the motor and the electrical equipments, produces less noise and permits its compactness without lowering the capacity.

It is to be noted that holes in the cylinder block can be shaped unlike those of the previous embodiments. For instance, they may be circular or slits.

The concavity in the cylinder block of the novel hermetically sealed rotary compressor is provided not only to install electrical parts connected with the terminal feeding electrical power to the motor, such as a lead wire from the motor, and connectors for the lead wire and for the terminal but to assure an appropriate insulation interval. Due to the concavity described hereinbefore, a portion of the internal wall of the casing is not contacted and supported by any element. It is preferable that the ratio of the concave portion to the full circumference of the internal wall is limited to under 15%.

Further, it will be understood that the recess or concavity may be made in the little portion of the side wall from the top face or bottom face of the cylinder, and in case this little concavity is made in the side wall of the cylinder, the full circumference of the internal wall of the casing is fitted by the cylinder.

What is claimed is:

1. In a hermetically sealed rotary compressor of the type comprising:

a vertically disposed hermetically sealed cylindrical casing having a cylindrical sidewall, an electric motor force-fitted within the casing in coaxial relation therewith, said motor having a rotor and a stator including a stator winding, a rotary refrigerant compressing device driven by the motor, said comnressing device including (i) a cylinder block defining a cylinder in the center thereof, and (ii) top and bottom end plates closing said cylinder at each of its opposite ends, the outer diameter of the top end plate being less than the inner diameter of the stator winding of the eiectric motor, a terminal for feeding electrical power to the motor attached to said sidewall of said casing, said cylinder block being secured within the casing such that said top end plate is disposed in a hollow space defined by the rotor, the stator winding of the electric motor, and the cylinder block, the improvement comprising:

said cylinder block being formed in a substantially circular shape in plan having a concavity in its sidewall, substantially said entire sidewall of said cylinder block, excepting said concavity, being force-fitted against the internal surface of said sidewall of said casing, said terminal attached to said sidewall of said casing being situated in the opening framed by the concavity in the sidewall of the cylinder block and the internal surface of the sidewall of the casing, with said concavity being only large enough to receive said terminal, said stator winding being disposed close to the upper surface of the cylinder block, and said top end plate having a discharge muffler thereon, said discharge muffler being disposed in said hollow space together with said top end plate.

2. The compressor as set forth in claim 1, wherein the concavity in the sidewall of the cylinder block comprises 15% or less of the circumference of said sidewall whereby 85% or more of said cylinder block sidewall is force-fitted against the internal wall of said casing.

3. The compressor as set forth in claim 1, wherein the bottom end plate further comprises a discharge muffler.

4. The compressor as set forth in claim 1, wherein the bottom end plate further comprises an auxiliary discharge muffler, and further comprising a passage for passing gaseous refrigerant from the discharge muffler on said bottom end plate, said passage comprising communicating holes extending through the top end plate, the cylinder block and the bottom end plate.

5. The compressor as set forth in claim 1, wherein the cylinder block further comprises a plurality of elliptical holes or slots extending vertically through the block and disposed between the cylinder and the periphery of the cylinder block, said slots having their longitudinal axes generally perpendicular to the radius of said cylinder for aiding in noise suppression.

6. The compressor as set forth in claim 1, wherein said bottom wall of said casing is substantially a disk having reinforcing ribs or bending portions welded to the inner surface of the cylindrical side wall of the casing.

7. The compressor as set forth in claim 1, wherein said bottom wall of said casing has reinforcing ribs, the bottom wall further having upwardly bending portions welded to the inner surface of the cylindrical side wall of the casing.

8. The hermetically sealed rotary compressor of claim 1, wherein:

the motor has a laminated core, the height of said laminated core being less than the inner diameter of cylinder block, and said sealed casing has a diameter greater than 3 times the inner diameter of the cylinder block.

* * * * *